US008056464B2

(12) United States Patent
Cazalieres et al.

(10) Patent No.: US 8,056,464 B2
(45) Date of Patent: Nov. 15, 2011

(54) FIRING BRAKES FOR CANNONS OR MORTARS

(75) Inventors: Jean-Francois Cazalieres, Saint Germain du Puy (FR); Francois-Xavier Renard, Bourges (FR)

(73) Assignee: Nexter Systems, Roanne (FR)

( * ) Notice: Subject to any disclaimer, the term of this patent is extended or adjusted under 35 U.S.C. 154(b) by 57 days.

(21) Appl. No.: 12/662,908

(22) Filed: May 11, 2010

(65) Prior Publication Data

US 2010/0288118 A1 Nov. 18, 2010

(30) Foreign Application Priority Data

May 13, 2009 (FR) ..... 09 02293

(51) Int. Cl.
*F41A 25/00* (2006.01)

(52) U.S. Cl. ..... 89/43.01

(58) Field of Classification Search ..... 89/42.01, 89/43.01, 1.1, 198, 1.06, 191.01
See application file for complete search history.

(56) References Cited

U.S. PATENT DOCUMENTS

| | | | | |
|---|---|---|---|---|
| 749,215 | A * | 1/1904 | McClean | 89/43.01 |
| 1,469,918 | A * | 10/1923 | De Maine | 89/43.01 |
| 1,845,218 | A * | 2/1932 | Barnes | 89/43.01 |
| 1,877,118 | A * | 9/1932 | Barnes | 89/42.01 |
| 2,066,319 | A | 1/1937 | Barnes | |
| 4,648,306 | A | 3/1987 | Zielinski | |
| H1010 | H | 1/1992 | Kasten et al. | |
| 6,227,098 | B1 * | 5/2001 | Mason | 89/193 |
| 2009/0126558 | A1 | 5/2009 | Kohnen | |

FOREIGN PATENT DOCUMENTS

| | | |
|---|---|---|
| DE | 10 2006 014 155 A1 | 9/2007 |
| FR | 2 789 760 | 8/2000 |
| FR | 2 869 406 | 10/2005 |

OTHER PUBLICATIONS

French Search Report issued in French Patent Application No. FR 0902293 on Dec. 7, 2009 (with translation).

* cited by examiner

*Primary Examiner* — Michael Carone
*Assistant Examiner* — Jonathan C Weber
(74) *Attorney, Agent, or Firm* — Oliff & Berridge, PLC

(57) ABSTRACT

The invention relates to firing brake assembly for weapons of the type incorporating an actual firing brake and means to modulate the function of said firing brake wherein the modulating means are in the form of a chamber equipped with a piston delimiting an upstream chamber and a downstream chamber, the upstream chamber communicating with the gun barrel by means of an upstream circuit ensuring that part of the combustion gases are taken up and a downstream chamber filled with a fluid and communicating with the firing brake by means of a downstream circuit.

11 Claims, 2 Drawing Sheets

FIRING BRAKES FOR CANNONS OR MORTARS

BACKGROUND OF THE INVENTION

1. Field of the Invention

The technical sector of the present invention is that of firing brakes for cannons or mortars enabling a reduction in the recoil.

2. Description of the Related Art

The recoil of this type of weapon is known to be reduced by adding a brake body to the weapon that comprises an oil-filled chamber and a rod fixed to a piston to draw the oil.

Thus, patents FR-2869406 and FR-2789760 disclose embodiments of firing brakes.

However, a certain rigidity has been noted in the functioning of these brakes since it is not possible to vary the braking force of the brake according to a certain number of factors such as the elevation laying of the weapon, the type of ammunition used, the desired recoil profile, the temperature.

SUMMARY OF THE INVENTION

The aim of the present invention is to supply a device that enables the functioning of an actual firing brake to be modulated according to the conditions of use of the weapon.

The invention thus relates to a firing brake assembly for weapons of the type incorporating an actual firing brake and means to modulate the function of said firing brake, wherein the modulating means are in the form of a chamber provided with a piston delimiting an upstream chamber and a downstream chamber, the upstream chamber communicating with the gun barrel by means of an upstream circuit ensuring that part of the combustion gases are taken up and a downstream chamber filled with a fluid and communicating with the firing brake by means of a downstream circuit.

According to one characteristic of the invention, the actual brake comprises a free piston delimiting a chamber that communicates with the downstream circuit.

According to another characteristic of the invention, the upstream circuit comprises a pressure adjustment valve.

According to yet another characteristic of the invention, the upstream circuit communicates with the inside of the barrel by means of a calibrated opening.

According to another characteristic of the invention, the downstream circuit comprises at least one flow adjustment valve for the fluid circulating in this downstream circuit.

According to yet another characteristic of the invention, the firing adjustment valves are constituted by a valve to adjust the flow according to the temperature, a valve to adjust the desired recoil profile for the weapon and a valve to be adjusted according to the type of ammunition.

According to yet another characteristic of the invention, the modulating means are made collinearly to the gun barrel.

According to another characteristic of the invention, the actual brake is mounted in parallel to the gun barrel.

According to yet another characteristic of the invention, the actual brake is mounted collinearly to the gun barrel.

A first advantage of the present invention lies in the possibility of modifying the functioning conditions of the firing brake.

Another advantage lies in the hardening (and thus the shortening) of the recoil phase of the weapon.

BRIEF DESCRIPTION OF THE DRAWINGS

Other characteristics, particulars and advantages of the invention will become more apparent from the additional description of the different embodiments given hereafter by way of example with reference to the appended drawings, in which.

DETAILED DESCRIPTION OF PREFERRED EMBODIMENTS

Figure 1:
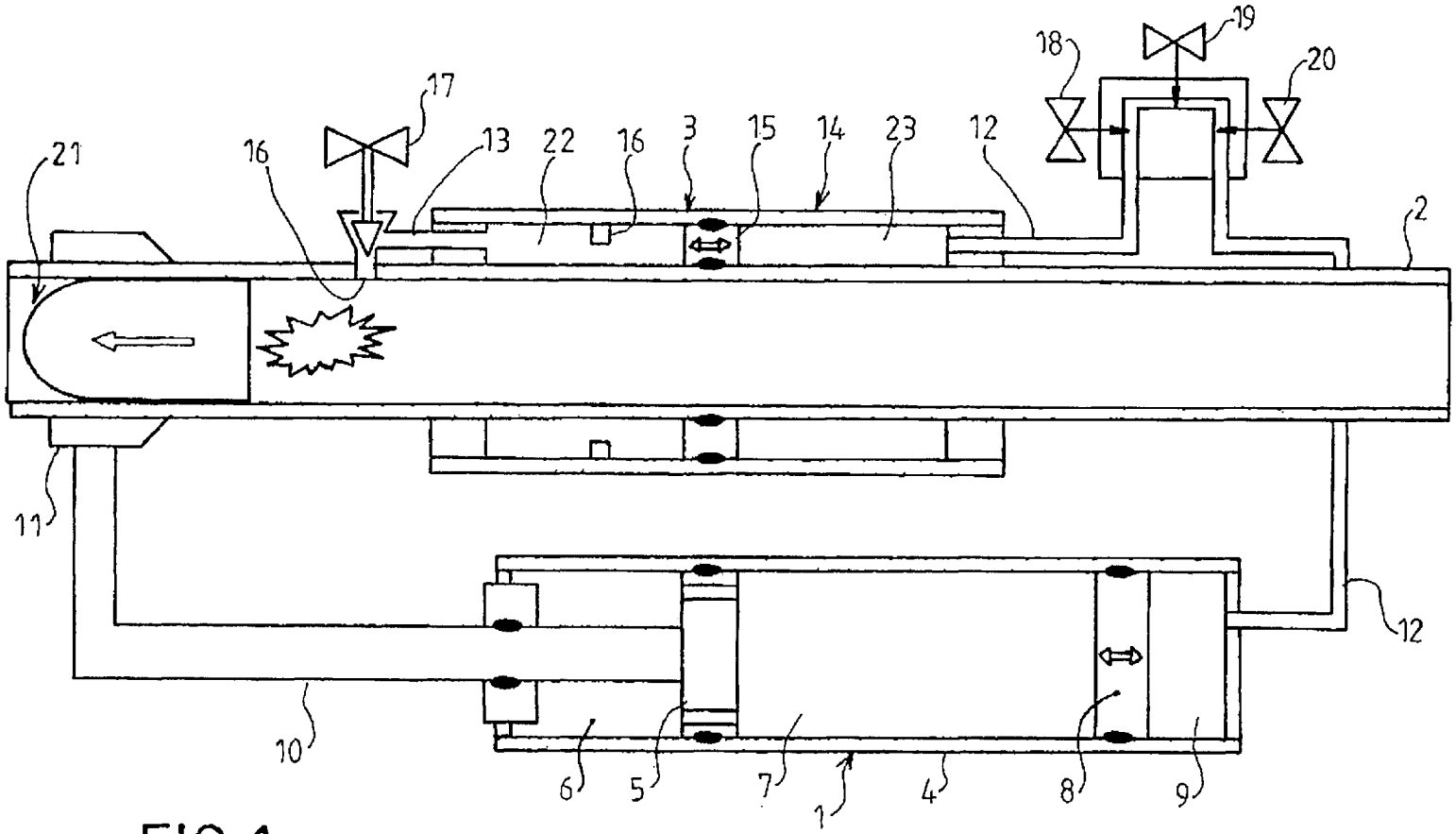
FIG. 1 is a section of a first embodiment of the invention.

FIG. 1 shows a section of the actual firing brake assembly 1 fastened to the barrel 2 of a weapon and modulating means 3.

The firing brake 1 is classical in its construction and can be seen to comprise a casing 4 enclosing a fluid and fastened to the partially shown frame 11 of the weapon. A drawing piston 5 sliding in the casing is rigidly fastened to the gun barrel 2. This piston delimits an upstream chamber 6 and a downstream chamber 7.

The modulating means 3 are in the form of a chamber 14 equipped with a free piston 15 delimiting an upstream chamber 22 and a downstream chamber 23, a limit stop 16 being fixed in the casing so as to limit the forward translation of the piston 15. The upstream chamber 22 is made to communicate with the gun barrel 2 by means of a downstream circuit 13 that takes up part of the combustion gases from the propellant charge of the ammunition 21 by means of a calibrated opening 16. A valve 17 is positioned in the upstream circuit 13 so as to adjust the pressure level in the chamber 22. The downstream chamber 23 is filled with fluid, oil for example, and is made to communicate with the firing brake 1 by means of a downstream circuit 12 also incorporating firing adjustment valves 18, 19 and 20.

The valve 18 is, for example, a valve to adjust the oil flow depending on the external temperature, valve 19 is dedicated to the adjustment of the weapon's recoil and valve 20 ensures adjustment according to the type of ammunition. These valves enable the pressure of the fluid circulating in the downstream circuit 12 to be adjusted.

The actual brake 1 comprises, in the downstream chamber 7, a free piston 8 delimiting a chamber 9 communicating with the downstream circuit 12.

The brake assembly according to the invention functions as follows. When the propellant charge is ignited, part of the combustive gases is taken up by the upstream circuit 13 and fills the chamber 22. These pressurized gases are used as motor means to ensure the piston's 15 movement. As the pressure builds up, the piston 15 compresses the fluid in the downstream chamber 23 so as to modulate the functioning of the actual firing brake 1 by the transfer of fluid towards the chamber 9. This displacement of fluid in fact causes the displacement of the piston 8 and thereafter a reduction in the volume of the chamber 7. The pressure increases in the downstream chamber 7 thereby hardening the recoil phase of the brake's piston 5 and thus reducing the recoil distance. The modulating means 3 thus constitute means to modify the braking characteristics of the actual brake.

Modulation may be effected by acting either simultaneously or separating on each of the valves. Thus, by acting on valve 17, the passage for the gases is reduced according to the laying angle of the weapon. The more open valve 17, the greater the action of the modulating means 3. Indeed, opening valve 17 increases the pressure exerted by the gases on the piston 15. In practical terms, recoil is sought to be reduced when laying at high elevation angles. Valve 17 will thus be opened more fully for high elevation angles.

By acting on valve 18 the passage of oil is reduced according to the temperature, thereby enabling account to be made of the modifications of the viscosity of the oil linked to the temperature. In practical terms, the higher the temperature, the further valve 18 will be closed, since the more fluid the oil. By acting on valve 19 the oil passage will be reduced according to the desired recoil profile (thereby to some extent modifying the recoil time). The more open valve 19, the greater the action of means 3 and thus the lower the recoil time.

It can be observed that if valve 17 is closed and valves 18 to 20 are open, the brake operates as a normal firing brake. By acting on valve 20, the oil passage may be reduced according to the type of ammunition used, and thus the firing impulsion caused by the latter can be reduced. This valve may incorporate different pre-adjusted opening positions for the different rounds used. In practical terms, the stronger the recoil impulsion, the more valve 20 will be opened to increase the action of means 3.

The implementation of three separate valves 18, 19 and 20 enables the adjustment settings to be finely tuned. The order of the valves on line 12 is of no particular importance.

FIG. 1 shows a classical arrangement of a firing brake 1 in which this brake is positioned in parallel to the gun barrel 2. This parallel mounting does not require further description.

Figure 2:
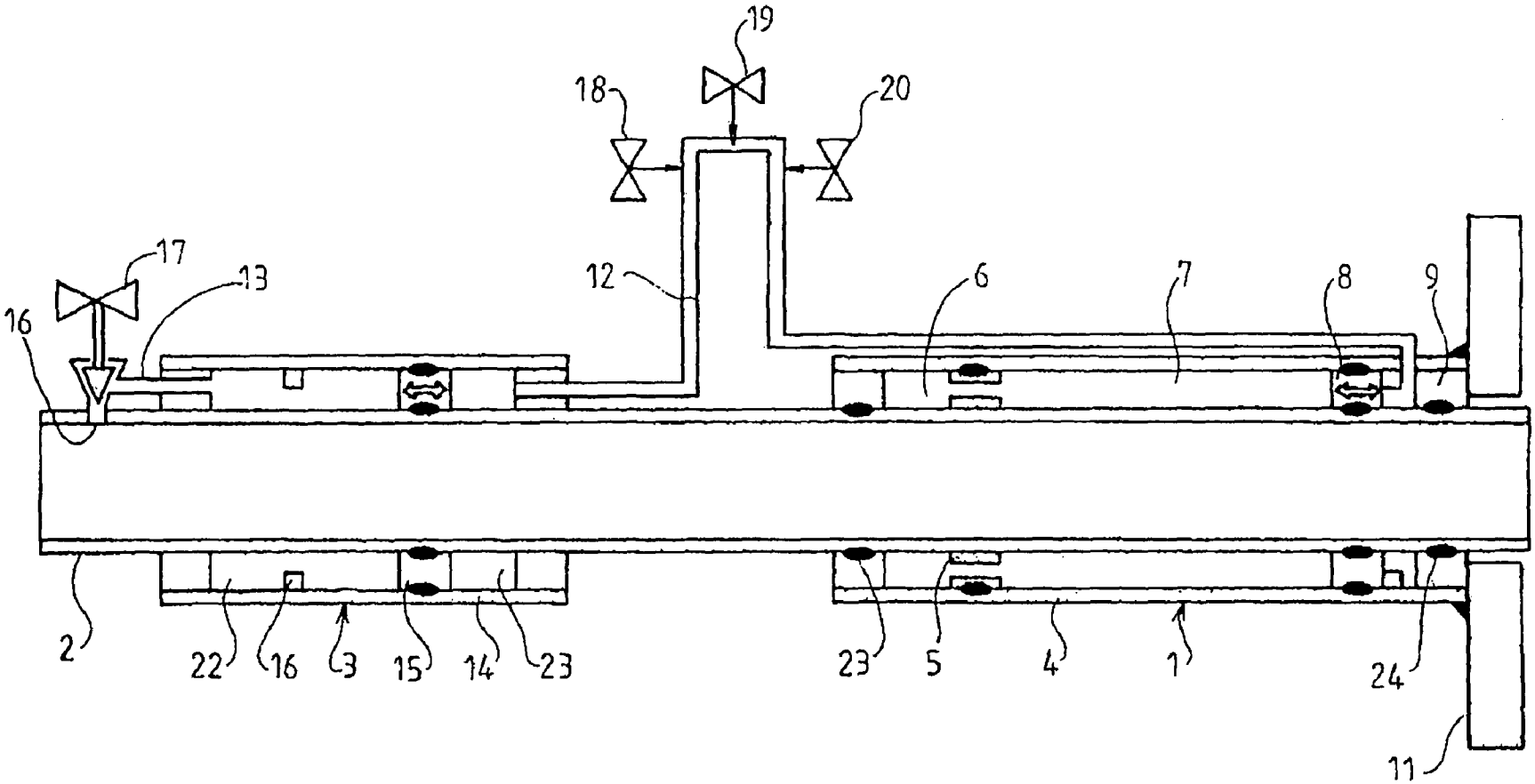
FIG. 2 is a section of a second embodiment of the invention.

FIG. 2 shows a variant embodiment of the assembly in which the actual brake 1 is mounted coaxially to the gun barrel 2. In this Figure, identical or similar elements of the actual brake 1 are given the same references. Thus we find chamber 4 through which the barrel 2 passes and upon which it is mounted by means of guidance supported equipped with sealing rings 23 and 24. This brake 1 is naturally rigidly fastened to the frame 11 of the weapon.

In this embodiment, the piston 5 is rigidly fastened to the gun barrel 2 and delimits chambers 6 and 7 in the casing. The free piston 8 is arranged in the vicinity of the frame 11 and delimits the chamber 9. The adjustments previously described are the same with valves 17, 18, 19 and 20.

Functioning is as follows.

During the recoil phase of the barrel 2, the latter slides with respect to the casing 4. The piston 5 linked to the barrel compresses the chamber 7 and the oil transfer ensuring the braking is made between chambers 6 and 7. The addition of the modulating means 3 introduces a variation in the pressure of the fluid in chamber 9 and thus an increase in the pressure in chamber 7 by displacement of the free piston 8 as explained previously. This results in a modification of the braking characteristics of the brake 3.

The advantage of such a structure lies in the gain in volume of the actual brake assembly and modulator and enables greater compactness to be obtained.

With such an embodiment, it is also possible to simplify the structure and manufacture of the downstream circuit. The manifolds 12, which must nevertheless be flexible (and reinforced) hydraulic piping, can be reduced to accompany the relative displacement of the gun barrel to which means 3 are linked.

This embodiment also enables the firing stresses to be made collinear to the braking stresses. The brake's performance is thereby improved.

What is claimed is:

1. A firing brake assembly for weapons of the type incorporating a firing brake and means to modulate the function of said firing brake, wherein said modulating means are in the form of a chamber equipped with a piston delimiting an upstream chamber and a downstream chamber, said upstream chamber communicating with a gun barrel by means of an upstream circuit ensuring that part of the combustion gases are taken up and said downstream chamber being filled with a fluid and communicating with said firing brake by means of a downstream circuit.

2. A firing brake assembly for weapons according to claim 1, wherein said actual brake comprises a free piston delimiting a chamber that communicates with said downstream circuit.

3. A firing brake assembly for weapons according to claim 1, wherein said upstream circuit comprises a pressure adjustment valve.

4. A firing brake assembly for weapons according to claim 3, wherein said upstream circuit communicates with the inside of said barrel by means of a calibrated opening.

5. A firing brake assembly for weapons according to claim 2, wherein said upstream circuit comprises a pressure adjustment valve.

6. A firing brake assembly for weapons according to claim 1, wherein said downstream circuit comprises at least one flow adjustment valve for the fluid circulating in said downstream circuit.

7. A firing brake assembly for weapons according to claim 6, wherein said firing adjustment valves are constituted by a valve to adjust the flow according to the temperature, a valve to adjust the desired recoil profile for said weapon and a valve to be adjusted according to the type of said ammunition.

8. A firing brake assembly for weapons according claim 1, wherein said modulating means are made collinearly to said gun barrel.

9. A firing brake assembly for weapons according to claim 1, wherein said actual brake is mounted in parallel to said gun barrel.

10. A firing brake assembly for weapons according to claim 1, wherein said actual brake is mounted collinearly to said gun barrel.

11. A firing brake assembly for weapons according to claim 6, wherein said modulating means are made collinearly to said gun barrel.

* * * * *